United States Patent [19]

Koike et al.

[11] Patent Number: 5,022,918

[45] Date of Patent: Jun. 11, 1991

[54] HEAT-RESISTANT ALUMINUM ALLOY SINTER AND PROCESS FOR PRODUCTION OF THE SAME

[75] Inventors: Seiichi Koike; Hiroyuki Horimura; Masao Ichikawa; Noriaki Matsumoto, all of Saitama, Japan

[73] Assignee: Honda Giken Kogyo Kabushiki Kaisha, Tokyo, Japan

[21] Appl. No.: 278,581

[22] Filed: Dec. 1, 1988

[30] Foreign Application Priority Data

| | | | |
|---|---|---|---|
| Dec. 1, 1987 | [JP] | Japan | 62-301539 |
| Dec. 2, 1987 | [JP] | Japan | 62-303239 |
| Dec. 4, 1987 | [JP] | Japan | 62-305904 |
| Dec. 10, 1987 | [JP] | Japan | 62-310963 |
| Feb. 9, 1988 | [JP] | Japan | 63-28206 |
| Feb. 10, 1988 | [JP] | Japan | 63-27786 |
| Oct. 20, 1988 | [JP] | Japan | 63-264467 |

[51] Int. Cl.[5] ..... B22F 1/00

[52] U.S. Cl. ..... 75/229; 75/249; 75/236; 419/5; 419/66; 419/24; 419/10; 419/17; 419/32; 419/33; 419/23; 428/549

[58] Field of Search ..... 75/249, 229, 236; 419/5, 66, 24, 10, 17, 32, 33, 23; 428/549

[56] References Cited

U.S. PATENT DOCUMENTS

| | | | |
|---|---|---|---|
| 4,297,136 | 10/1981 | Pickens et al. | 75/206 |
| 4,347,076 | 8/1982 | Ray et al. | 75/2.5 R |
| 4,623,388 | 11/1986 | Jatkar et al. | 75/232 |
| 4,755,221 | 7/1988 | Paliwal et al. | 75/244 |
| 4,889,582 | 12/1989 | Simon et al. | 148/12.7 A |

FOREIGN PATENT DOCUMENTS

| | | |
|---|---|---|
| 0105595 | 4/1984 | European Pat. Off. . |
| 59-164488 | 8/1984 | Japan . |
| 1300752 | 12/1972 | United Kingdom . |
| 2179369 | 3/1987 | United Kingdom . |

*Primary Examiner*—Brooks H. Hunt
*Assistant Examiner*—Leon Nigohosian, Jr.
*Attorney, Agent, or Firm*—Lyon & Lyon

[57] ABSTRACT

A heat-resistant aluminum alloy sinter comprises 5 to 12% by weight of Cr, less than 10% by weight of at least one selected from the group consisting of Co, Ni, Mn, Zr, V, Ce, Fe, Ti, Mo, La, Nb, Y and Hf, and the balance of Al containing unavoidable impurities. A silicon carbide fiber is included for reinforcing the sinter in a fiber volume fraction range of 2 to 30%.

11 Claims, 4 Drawing Sheets

400 25 μm

X400 25 μm

X400 25 μm 400 25 μm

HEAT-RESISTANT ALUMINUM ALLOY SINTER AND PROCESS FOR PRODUCTION OF THE SAME

BACKGROUND OF THE INVENTION

1. Field of the Invention

The present invention relates to a heat-resistant aluminum alloy sinter having a high-temperature strength, and a process for production of the same.

2. Description of the Prior Art.

There are conventionally known heat resistant aluminum alloy sinters made from Al-Fe based alloy powders such as Al-Fe-Ce. Al-Fe-Mo, etc., by utilizing a quench solidification see Japanese Patent Application Laid-open No.52343/86).

However, the above prior art alloys exhibit inferior hot workability or processibility in hot extrusions because of their low toughness and ductility. This atribute should be improved.

SUMMARY OF THE INVENTION

With the foregoing in view. it is an object of the present invention to provide a sinter of the type described above, which is made using an aluminum alloy having an excellent high-temperature strength and in which the hot processibility in the process of production of members is improved.

To accomplish the above object according to the present inventIon, there is provIded a beat-resistant aluminum alloy sinter comprising 5 to 12% by weight of Cr, less than 10% by weight of at least one selected from the group consisting of Co, Ni, Mn, Zr, V, Ce, Fe, Ti, Mo, La, Nb, Y and Hf, and the balance of Al containing unavoidable impurities.

In addition, according to the present invention, there is provided a heat-resistant aluminum alloy sinter of the type described above, which contains Fe and Zr, the. Fe content being set in a range of 1 to 5% by weight, and the Zr content being set in a range of 0.5 to 3% by weight.

Further, according to the present invention. there is provided a fiber-reinforced heat resistant aluminum alloy sinter comprising a matrix made of an aluminum alloy which contains 5 to 12% by weight of Cr. less than 10% by weight of at least one element selected from the group consisting of Co, Ni, Mn, Zr, V, Ce, Fe, Ti, Mo, La, Nb, Y and Hf, and the balance of Al containing unavoidable impurities; and a reinforcing fiber which is a short fiber with a fiber volume fraction in a range of 2 to 30%.

Yet further, according to the present invention, there is provided a fiber-reinforced heat-resistant aluminum alloy sinter of the type described above, high contains Fe and Zr, the Fe content being set in a range of 1 to 5% by weight, and the Zr content being set in a range of 0.5 to 3% by weight.

With the above it is possible to improve the hot processibility in the process of production of the sinter, and to provide the sinter with an excellent high-temperature strength.

If alloy elements are added to the aluminum matrix in concentrations above the solid-solution limit and are dissolved therein, and if fine precipitates and crystallizates consisting of the alloy elements and the matrix are permitted to be distributed in the matrix. it is possible to reinforce the resulting aluminum alloy. In this case, the precipitates and the like are stable at ambient temperature, but a reinforcing effect provided by the precipitates and the like is gradually lost as the temperature increases, because they are dissolved into or coalesced in the matrix. The rate of dissolving of the precipitates and the like into the matrix primarily depends upon the diffusion coefficient ($cm^2/sec$ ) of the alloy elements in the aluminum and hence, in order to improve the heat resistance of the aluminum alloy sinter. it is necessary to employ alloy elements having a small diffusion coefficient.

According to the present invention, Cr (having a diffusion coefficient in aluminum of $10^{-16}$ to $10^{-15}$ $cm^2/sec.$) is employed as an alloy element having a small diffusion coefficient and therefore. it is possible to improve the heat resistance of the resulting sinter.

The alloy elements having a function similar to that of CR include Co, Ni, Mn, Zr, V, Ce, Fe, Ti, Mo, La, Nb, Y and Hf. The use of at least one of these elements in combination with Cr makes it possible to improve the heat resistance of the resulting sinter.

It should be noted that it is necessary to provide a sufficiently large cooling rate introduction of the powder metal because the mechanical properties of the resulting sinter are damaged if the precipitates are coalesced. The cooling rate satisfying this requirement is in a range of $10^2$ to $10^6$ $^oC/sec$. A cooling rate in this range enables the maximum diameter of the precipitates and the like to be controlled to 10 $\mu m$ or less.

The function of each alloy element and the reason why the amount of each alloy element added is limited are as follows:

Cr: This alloy element functions to improve the ambient-temperature strength and high-temperature strength of the resulting sinter and to improve the creep characteristic However, if the added amount is less than 5% by weight, the ambient- and high-temperature strengths are reduced. On the other hand. if the added amount exceeds 12% by weight, the toughness and ductility of the sinter are reduced, thus, degrading its hot proccessibility.

Co, Ni, Mn, Zr, y, Ce, Fe, Ti, Mo, La, Nb, Y, Hf : These alloy elements function to improve the ambient- and high-temperature strengths of the resulting sinter. However, if they are added in excess, the toughness and ductility are hindered, and the hot processibility is degraded. Therefore, the added amount thereof is limited to 10% by weight. In this case, the lower limit value of the added ,amount is about 1.5% by weight.

In sinters made with additions of Fe and Zr selected from the above-described various alloy elements, Fe is effective for improving the ambient temperature strength, the high-temperature strength and the Young's modulus. However, if the amount of Fe added is less than 1% by weight, the effect of the Fe addition is smaller. On the other hand. if the amount of Fe added exceeds 5% by weight the notch sensitivity is increased, and the elongation is reduced.

Zr functions to improve the toughness, the ductility and the creep characteristics of the sinter. Zr also improves the high-temperature strength through an age hardening mechanism. However, if the amount of Zr added is less than 0.5% by weight, the above-described effect is smaller. On the other hand, if the amount exceeds 3% by weight, the toughness and the ductility are reduced.

A fiber volume fraction (Vf) of the short fiber falling in the above-described range is suitable for sufficiently exhibiting its fiber reinforcing capacity. If the fiber volume fraction is lower than 2%, the fiber reinforcing capacity cannot be achieved. On the other hand. any fiber volume fraction exceeding 30% will cause an embrittlement, a deterioration of machinability and the like in the resulting sinter.

In addition according to the present invention, there is provided a process or producing a fiber-reinforced heat-resistant aluminum alloy sinter consisting of an aluminum alloy matrix with whiskers of silicon carbide dispersed in the matrix. The process consists of mixing an aluminum alloy powder with whiskers of silicon carbide while at the same time pulverizing them by utilizing a mechanical dispersion process, thereby preparing a composite powder consisting of the aluminum alloy and whiskers of silicon carbide, the aluminum alloy powder comprising 5 to 12% by weight of Cr, less than 10% by weight to at least one element selected from the group consisting of Co, Ni, Mn, Zr, V, Ce, Fe, Ti, Mo, La, Nb. Y and Hf, and the balance of Al containing unavoidable impurities, and then subjecting the composite powder to a sintering treatment. Here, the whiskers are thin pin-like or stick-like single crystals.

The mechanical dispersion process applied to the present invention is a method for mechanically mixing powders to be treated, while at the same time pulverizing them. By employment of this method, the aluminum alloy powder and whiskers of silicon carbide are mixed and pulverized to provide a composite powder containing whiskers of silicon carbide, which have a reduced aspect ratio (fiber length/fiber diameter), uniformly dispersed in the aluminum alloy matrix.

The sintering treatment of this composite powder enables the whisker of silicon carbide to be uniformly dispersed over the entire matrix.

In addition, according to the above technique, there is no need for a discentangling operation of the silicon carbide whiskers or for a screening operation for removing coaggregates which have not been open. Hence, with this method, it is possible to reduce the number of steps required for producing a sinter and also to improve the yield of the whiskers of silicon carbide, thereby reducing the cost of production of the sinter.

The above and other objects, features and advantages of the invention will become apparent from a reading of the following description of the preferred embodiments, taken in conjunction with the accompanying drawings.

DESCRIPTION OF THE PREFERRED EMBODIMENTS

The production of a heat-resistant aluminum alloy sinter is, in principle, carried out in sequence through steps of the preparation of an alloy powder, the green compacting thereof and the hot extrusion thereof. In this case. the sintering of the alloy powder occurs during the hot extrusion process.

A gas atomizing process, a roll process, a centrifugal spraying process or the like may be applied for the preparation of the alloy powder. The cooling rate in this case is of $10^2$ $10^6$° C./sec.

A vacuum pressure molding process, a CIP process (cold isostatic pressing process), a monoaxially pressing process or the like may be applied for the green cocacting of the powder.

If it is desired to provide an anti-oxidation of the green compact during heating in the hot extrusion, the heating thereof may be carried out in an inert gas atmosphere such as argon gas and nitrogen gas.

In some cases, the green compact may be subjected to a sintering treatment prior to the hot extrusion process. A hot pressing process such as a HIP process (hot isostatic pressing process) or the like may be applied for this treatment.

Short fibers (including whiskers) that can be used a reinforcing fiber in fiber-reinforced sinters include SiC, alumina, $Si_3N4$ and carbon whiskers, as Well as chopped SiC, chopped aluminum, chopped $Si_3N_4$ and chopped carbon fibers and the like.

Figure 3:
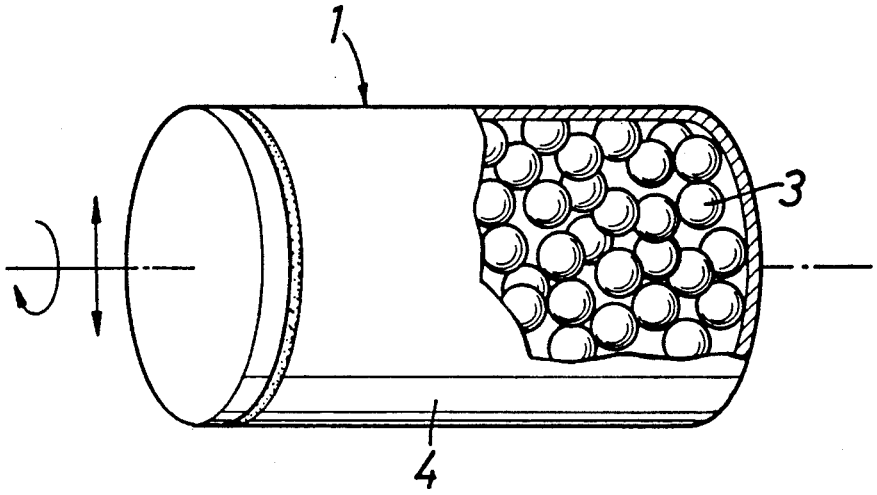
FIG. 3 is a perspective cutaway view of an essential portion of a vibration mill.
Figure 4:
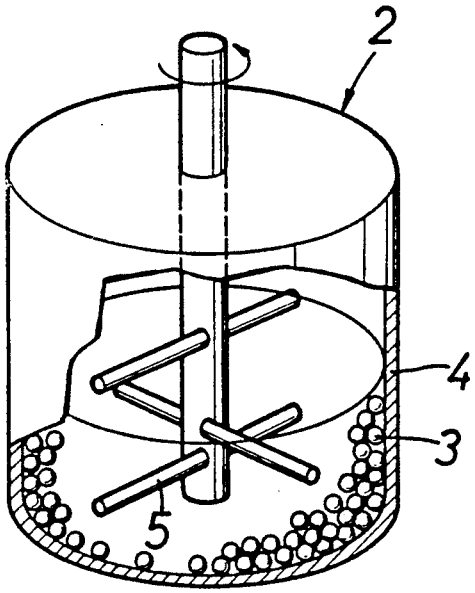
FIG. 4 is a perspective cutaway view of an essential portion of a high energy ball mill.

The mechanical dispersion process may be carried out using a vibration mill 1 shown in FIG. 3, or a high energy ball mill 2 shown in FIG. 4.

The vibration mill 1 is constructed so that a stainless steel pot 4 containing a large number of stainless steel balls 3 is rotated about its axis and vibrated radially.

The high energy ball mill 2 is constructed of stainless steel stirring impellers 5 disposed in a stainless steel pot 4 and containing a large number of stainless steel balls 3.

EXAMPLE 1

Aluminum alloy powders of a diameter of 105 μm or less and having compositions given in Table I were produced using a He gas atomizing process with a cooling rate of $10^2$ to $10^3$°C./Sec.

Then, the individual alloy powders were employed to produce a plurality of green compacts having a diameter of 50 mm and a length of 100 mm under a pressing force of 4,000 kg/cm$^2$ by utilizing a CIP process.

Then, each green compact was placed into a soaking furnace with an Ar gas atmosphere at 450° C. and left for one hour to effect a degassing treatment. Degassing was followed by a hot extrusion under conditions of heating temperature of 450° C. and an extrusion ratio of 14. thus providing sinters $A_1$ to $A_4$ and $a_1$ to $a_4$.

TABLE I

| | Chemical constituents (% by weight) | | | | | |
|---|---|---|---|---|---|---|
| Sinter | Cr | Fe | Mn | Zr | Ti | Al |
| $A_1$ | 11 | — | 1 | 1 | 0.5 | Balance |
| $A_2$ | 11 | 1 | — | 1 | — | Balance |
| $A_3$ | 11 | 3 | 2 | — | — | Balance |
| $A_4$ | 8 | — | 2 | 2 | — | Balance |
| $a_1$ | 11 | 5 | 3 | 2 | 1 | Balance |
| $a_2$ | 5 | — | — | — | — | Balance |
| $a_3$ | 22 | 2 | — | — | 1 | Balance |
| $a_4$ | 24 | — | — | — | — | Balance |
| $a_5$ | 11 | 3 | 2 | — | — | Balance |

Sinters $A_1$ to $A_4$ are examples prepared according to the present invention, and sinters $a_1$ to $a_5$ are comparative examples. The comparative example $a_5$ is a cast product.

Test pieces were cut away from the individual sinters $A_1$ to $A_4$ and $a_1$ to $a_4$ and the cast product $a_5$ and subjected to a tensile test to provide results as given in Table II. The term "Acceptable" in the estimation column in Table 11 represents those sinters with good hot processibility (i.e.) sinters with a tensile strength exceeding 30 kg/mm$^2$ at a temperature of 300+ C. and an elongation exceeding 1%). Sinters which do not satisfy these requirements were indicated by the term "failure".

TABLE II

| Sinter | Tensile strength (kg/mm$^2$) A.T.*3 | 200° C. | 300° C. | Elong.*1 (%) | M.D.*2 (μm) | Estimation |
|---|---|---|---|---|---|---|
| $A_1$ | 56 | 48 | 37 | 2.5 | 2 to 5 | Acceptable |
| $A_2$ | 55 | 45 | 35 | 2.0 | 2 to 5 | Acceptable |
| $A_3$ | 55 | 43 | 36 | 3.0 | 2 to 5 | Acceptable |
| $A_4$ | 52 | 46 | 35 | 1.5 | 2 to 5 | Acceptable |
| $a_1$ | 48 | 42 | 31 | 0 | 2 to 5 | Failure |
| $a_2$ | 26 | 19 | 14 | 5.0 | 2 to 5 | Failure |
| $a_3$ | 40 | 30 | 29 | 0 | 2 to 5 | Failure |
| $a_4$ | 35 | 25 | 27 | 0 | 2 to 5 | Failure |
| $a_5$ | 38 | 27 | 12 | 0 | 20 to 300 | Failure |

*1Elongation
*2Maximum diameter of crystallizate (a crystal generated from a molten or liquid phase metal through solidification) and precipitate (a crystal generated from a metal of solid phase or solid solution)
*3Ambient temperature It can be seen, in sinters $A_1$ to $A_4$ of the present invention, that the maximum diameter of crystallizates and precipitates is small, and the strengths at ambient temperature, 200° C. and 300° C. are substantially large, as compared with those of comparative examples $a_1$ to a. For example, the tensile strengths of sinters $A_1$ to $A_4$ 300°C. exceeds 35 kg/mm$^2$. Also the elongations of sinters $A_1$ to $A_4$ exceed 1%, and their hot processibility is good.

As apparent from comparison of the sinters $A_1$ to $A_3$ of the present invention with the comparative example $a_1$, it can be seen that if the net amount of alloy elements other than Cr are excessive, i.e., more than 10%, the tensile strength at ambient temperature, 200° C. and 300° C. is reduce and the elongation is also lost, resulting in a significant embrittlement.

As apparent from comparison of the sinters $A_1$ to $A_4$ of the present invention with the comparative example $a_2$, it can be seen that if no alloy elements other than Cr are added, the elongation is improved, but the tensile strength at ambient temperature, 200° C. and 300° C. is lower Furthermore, the percent of ambient tensile strength retained is less with comparative example $a_2$ as the temperature increases.

Because the comparative example $a_5$ is made by casting, the maximum diameter of the crystallizates and precipitates is larger, and due to this, the elongation is considerably reduced. and the tensile strength is also smaller. This means that even with the alloy having a composition falling within a specified composition range of the present invention, the maximum diameter of the crystallizates and precipitates should be controlled to a smaller diameter than that achievable by a casting process.

It can be seen from the comparative examples $a_3$ and $a_4$ that any excessive amount of Cr added will result in the elongation of the product being; thus causing considerable embrittlement.

EXAMPLE 2

Aluminum alloy powders having compositions given in Table III were produced in a procedure similar to that in Example 1, and the individual alloy powders were employed to produce sinters $B_1$ to $B_{10}$ and $b_1$ under the same conditions as in Example 1.

TABLE III

| Sinter | Chemical constituents (% by weight) Cr | Zr | Ti | Mn | Fe | Al | Hardness (Hmv) Before test | After test |
|---|---|---|---|---|---|---|---|---|
| $B_1$ | 11 | 2 | — | — | — | Balance | 157 | 154 |
| $B_2$ | 11 | — | 2 | — | — | Balance | 143 | 137 |
| $B_3$ | 11 | — | — | 2 | — | Balance | 156 | 147 |
| $B_4$ | 11 | — | — | — | 2 | Balance | 156 | 152 |
| $B_5$ | 11 | 1 | 1 | — | — | Balance | 148 | 143 |
| $B_6$ | 11 | 1 | — | 1 | — | Balance | 162 | 153 |
| $B_7$ | 11 | 1 | — | — | 1 | Balance | 159 | 148 |
| $B_8$ | 11 | — | 1 | 1 | — | Balance | 147 | 144 |
| $B_9$ | 11 | — | 1 | — | 1 | Balance | 163 | 152 |
| $B_{10}$ | 11 | — | — | 1 | 1 | Balance | 167 | 164 |
| $b_1$ | 11 | — | — | — | — | Balance | 125 | 120 |

Sinters $B_1$ to $B_{10}$ are examples prepared according to the present invention, and sinter $b_1$ is a comparative-example.

Test pieces Were cut away from the individual sinters $B_1$ to $B_{10}$ and $b_1$ and examined for variations in hardness due to prolonged heating. Results of the test are given in Table III. In this case, the heating temperature was 300° C. and the retention time was 100 hours.

As apparent from Table III, it can be seen that the use of Cr in combination with other alloy elements improves hardness and maintains the hardness relatively high even after heating. Sinter $B_1$, $B_8$ and $B_{10}$ exhibit a particularly small reduction in hardness due to heating.

EXAMPLE 3

Aluminum alloy powders having a diameter of 105 μm or less and compositions given in Table IV were produced in a manner similar to that in Example 1. Individual alloy powders were employed to produce sinters $D_1$ to $D_6$ and $d_1$ to $d_3$ under the same conditions as in Example 1.

TABLE IV

| Sinter | Chemical constituents (% by weight) Cr | Fe | Mn | Zr | Ti | Ni | Al |
|---|---|---|---|---|---|---|---|
| $D_1$ | 11 | 3 | — | — | 2 | — | Balance |
| $D_2$ | 5 | — | 2 | 2 | 1 | — | Balance |
| $D_3$ | 8 | — | 2 | 2 | 1 | — | Balance |
| $D_4$ | 11 | — | 1 | 1 | 0.5 | — | Balance |
| $D_5$ | 8 | — | 6 | — | 1 | — | Balance |
| $D_6$ | 8 | — | — | 6 | 1 | — | Balance |
| $d_1$ | 2 | — | 1 | 1 | — | — | Balance |
| $d_2$ | 8 | 6 | 2 | 2 | 2 | 3 | Balance |
| $d_3$ | 8 | 6 | — | — | 2 | 3 | Balance |
| $d_4$ | 8 | — | 2 | 2 | 1 | — | Balance |

Sinters $D_1$ to $D_6$ are examples prepared according to the present invention. and sinters $d_1$ to $d_4$ are comparative examples. Comparative example $d_4$ is a cast product.

Test pieces were cut away from the individual sinters $D_1$ to $D_6$ and $d_1$ to $d_3$ and the cast product $d_4$ and subjected to a tensile test to provide results given in Table V. The estimation column in Table V is as defined in Example 1.

TABLE V

| Sinter | Tensile strength (kg/mm²) A.T.*3 | 200° C. | 300° C. | Elong.*1 (%) | M.D.*2 (μm) | Estimation |
|---|---|---|---|---|---|---|
| $D_1$ | 45 | 40 | 30 | 2.5 | 2 to 5 | Acceptable |
| $D_2$ | 36 | 30 | 26 | 9.5 | 2 to 5 | Acceptable*4 |
| $D_3$ | 52 | 46 | 35 | 1.5 | 2 to 5 | Acceptable |
| $D_4$ | 56 | 48 | 37 | 2.5 | 2 to 5 | Acceptable |
| $D_5$ | 48 | 42 | 30 | 1.2 | 2 to 5 | Acceptable |
| $D_6$ | 49 | 40 | 30 | 5.6 | 2 to 5 | Acceptable |
| $d_1$ | 21 | 14 | 10 | 13.0 | 2 to 5 | Failure |
| $d_2$ | 51 | 40 | 33 | 0 | 2 to 5 | Failure |
| $d_3$ | 49 | 36 | 31 | 0 | 2 to 5 | Failure |
| $d_4$ | 38 | 27 | 12 | 6.0 | 20 to 500 | Failure |

*1Elongation
*2Maximum diameter of crystallizate and precipitate
*3Ambient temperature
*4on below 200° C.

EXAMPLE 4

Aluminum alloy powders having a diameter less than 105 μm and compositions given in Table VI were produced in a manner similar to that in Example 1. Individual alloy powders were employed to produce sinters $E_1$, $E_2$, and $e_1$ to $e_3$ under the same conditions as in Example I.

TABLE VI

| Sinter | Chemical constituents (% by weight) Cr | Fe | Zr | Tensile strengh (kg/mm²) A.T. | 300° C. | Elon. (%) | Hot Processibility |
|---|---|---|---|---|---|---|---|
| $E_1$ | 8 | 3 | 1 | 59.1 | 30.2 | 3.2 | Good |
| $E_2$ | 8 | 3 | 2 | 60.3 | 31.5 | 6.3 | Good |
| $e_1$ | 5 | — | — | 32.5 | 15.0 | 16 | Good |
| $e_2$ | 11 | — | — | 42.5 | 18.2 | 10.2 | Medial |
| $e_3$ | 15 | — | — | 43.2 | 23.4 | 1 | Bad |

Elon. = Elongation A.T. = Ambient temperature

Sinters $E_1$ and $E_2$ are examples prepared according to the present invention, and sinters $e_1$ to $e_3$ are comparative examples.

Test pieces were cut away from the individual sinters $E_1$, $E_2$, and $e_1$ to $e_3$ and subjected to a tensile test to provide results given in Table VI. Thos hot processibility in Table VI was decided by the presence or absence of cracks in the sinters following hot extrusion.

As apparent from Table VI, sinters $E_1$ and $E_2$, prepared according to the present invention and containing Cr, Fe and Zr each added in a specified amount, exhibit higher tensile strengths at ambient and high temperatures than comparative examples $e_1$ to $e_3$. Furthermore, sinters $E_1$ and $E_2$ exhibited moderate elongation and good hot processibility.

As apparent from the comparative examples $e_1$ to $_3$, it can be seen that an increase in Cr content results in an improved tensile strength at ambient temperature and at 300° C., but in a reduced elongation. Particularly, with an amount of Cr of 15% by weight, an amount exceeding the present invention's upper limit of 12% by weight, the elongation is considerably reduced, and the hot processibility is bad.

Addition of Fe is effective for improving the tensile strength at the ambient and increased temperatures, and such effect is large as compared with the effect observed with additions of Cr. However, if the amount of Fe added exceeds 5% by weight, the elongation is considerably reduced, and the hot processibility is bad.

The elongation characteristic and hot processibility reduced due to the addition of Fe can be compensated for by the addition of Zr. However, if the amount of Zr added exceeds 3% by weight, such compensating effect of Zr is not exhibited. The addition of Zr also improves the tensile strength at the ambient and increased temperatures.

EXAMPLE 5

Aluminum alloy powders having a diameter of 105 μm or less and compositions given in Table VII were produced in a manner similar to that in Example I, and the individual alloy powders Were employed to produce sinters $F_1$ to $F_3$, and $f_1$ to $f_3$ under the same conditions as in Example 1. However, in the hot extrusion process, the extruding ratio was set at 12.

TABLE VII

| Sinter | Chemical constituents (% by weight) Cr | Fe | Zr | Mn | Ti | Mo | Al |
|---|---|---|---|---|---|---|---|
| $F_1$ | 8 | 1.5 | 2 | — | — | — | Balance |
| $F_2$ | 8 | 3 | 2 | — | — | — | Balance |
| $F_3$ | 11 | 3 | 2 | — | — | — | Balance |
| $f_1$ | 8 | 16 | 2 | — | — | — | Balance |
| $f_2$ | 2 | 3 | 2 | — | — | — | Balance |
| $f_3$ | — | — | 2 | — | — | 3 | Balance |

Sinters $F_1$ to $F_3$ are examples prepared according to the present invention, and sinters $f_1$ to $f_3$ are comparative examples. Sinter $F_2$ has the same composition as the sinter $E_2$ given in Table IV.

Test pieces were cut away from the individual sinters $F_1$ to $F_3$ and $f_1$ to $f_3$ and subjected to three aging tests wherein they were maintained at heating temperatures of 300° C., 400° C. and 500° C. for ten hours, respectively. The individual test pieces before and after aging were subjected to a tensile test at to 300° C. Results of the tests are given in Table VIII. In Table VIII, $\sigma_B$ corresponds to the tensile strength (kg/mm²), and a corresponds to the elongation (%).

TABLE VIII

| Sinter | After aging Treating condition 300° C., 10 Hr. $\sigma_B$ | $\epsilon$ | 400° C., 10 hr. $\sigma_B$ | $\epsilon$ | 500° C., 10 hr. $\sigma_B$ | $\epsilon$ | Before aging $\sigma_B$ | $\epsilon$ |
|---|---|---|---|---|---|---|---|---|
| $F_1$ | 27 | 2.5 | 32 | 2 | 23 | 8 | 27 | 3 |
| $F_2$ | 31 | 2 | 38 | 1.5 | 26 | 6 | 32 | 2 |
| $F_3$ | 34 | 1.5 | 40 | 1.2 | 29 | 4 | 34 | 1.5 |
| $f_1$ | 38 | 0 | 36 | 0 | 27 | 4 | 39 | 0 |
| $f_2$ | 22 | 9 | 24 | 10 | 16 | 12 | 22 | 12 |
| $f_3$ | 24 | 2 | 27 | 1 | 20 | 5 | 25 | 2 |

As apparent from comparison of the sinters $F_1$ and $F_2$, prepared according to the present invention with the sinter $f_1$, a comparative example. It can be seen that as the amount of Fe increases the tensile strength increases irrespective of whether not the aging treatment is carried out, but the elongation is reduced.

As apparent from comparison of the sinters $F_2$ and $F_3$ prepared according to the present invention, with the sinter $f_2$, a comparative example, it can be seen that if the amount of Cr increases, the tensile strength increases irrespective of whether or not the aging treatment is carried out, but the elongation is reduced..

In the sinters $F_1$ to $F_3$, prepared according to the present invention, it can be seen that the addition of Zr increases the tensile strength irrespective of whether the aging treatment is carried out or not, and particularly, those subjected to the aging treatment at 400° C. are larger in strength improving effect.

As apparent from comparison of the comparative examples $f_2$ and $f_3$ with sinters, $F_1$ to $F_3$ it can be seen that if the amount of Cr added is small, the strength improving effect provided by the aging treatment is smaller, and the reduction in tensile strength when aged at 500° C. for 10 hours is larger.

In view of differences in tensile strength of all the sinters due to whether or not the aging treatment is carried out, it can be seen than an improvement in tensile strength cannot expected when the aging treatment is carried out at 300° C. Furthermore, tensile strength is reduced below unaged values when the sinters are aged at 500° C. for 10 hours.

Figure 1:
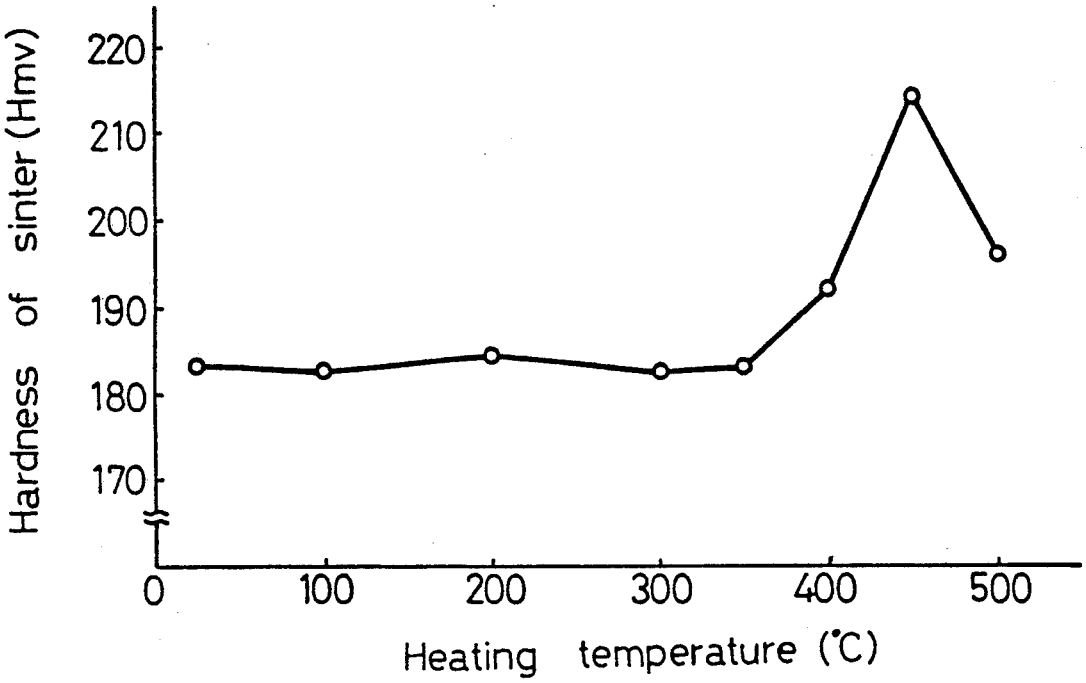
FIG. 1 is a graph illustrating a relationship between the heating temperature and the hardness of a sinter.

Sinters according to the present invention were maintained at 25° C., 100° C., 200° C., 300° C., 400° C. and 500° C. for a period of one hour at each temperature and examined for the surface hardness thereof (micro Vickers hardness Hmv; a load of 300 g was used ) after being cooled, thus providing results shown in FIG. 1.

FIG. 1 demonstrates that the hardness increases at a heating temperature of approximately 350° C. or more and reaches the maximum level at a heating temperature of approximately 450 C., and a sufficiently large hardness is achieved even at a heating temperature of 500° C.

Figure 2:
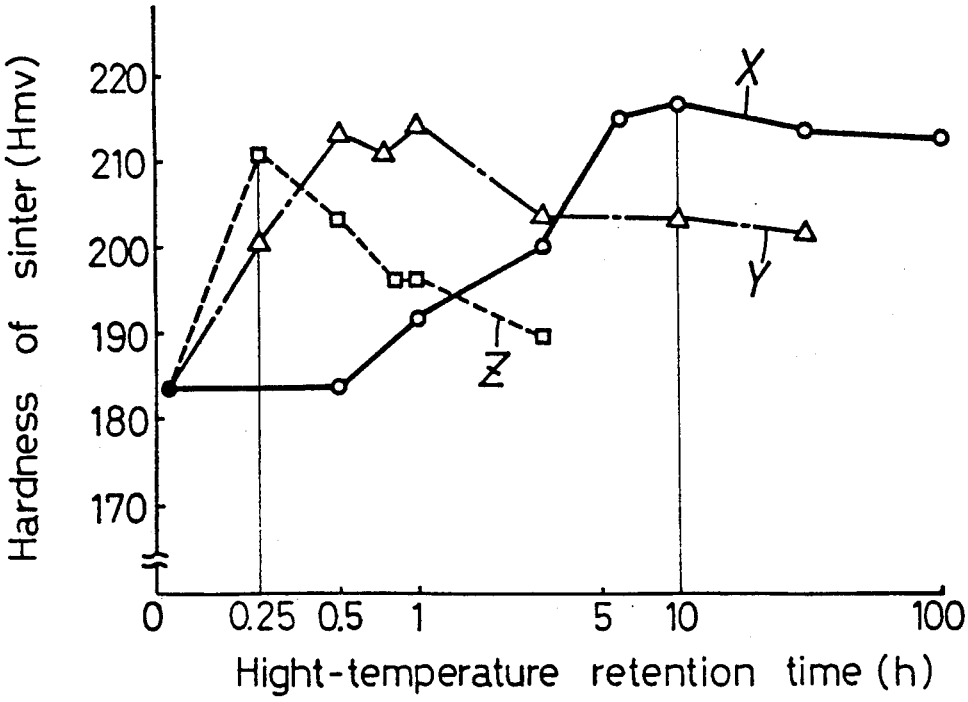
FIG. 2 is a graph illustrating a relationship between the high-temperature retention time and the hardness of the sinter.

Further, the sinter $F_2$ according to an example of the present invention was also examined for the relationship between the retention time and the surface hardness (micro Vickers hardness Hmv; a load of 300 g was used ) at heating temperatures of 400° C., 450° C. and 500° C. The results of the test are shown in FIG. 2. Line X corresponds to the case at 400° C.; line Y corresponds to the case at 450° C., and a line Z corresponds to the case at 500° C.

It can be seen from FIG. 2 that at a heating temperature of 400° C. the hardness reaches the maximum level of 217 Hmv in a retention time of approximately 10 hours the maximum level of 214 Hmv in a retention time of one hour at the heating temperature of 450° C.; and the maximum level of 211 Hmv in a retention time of 15 minutes at the heating temperature of 500° C.

It can also be seen from FIGS. 1 and 2 that an optimal range of temperatures for the aging treatment is between approximately 350 and 500° C.

When the aging temperature is set at a lower level rather than at a higher level, it is possible to provide a larger maximum hardness, but a longer retentiOn time is required in such a case. Taking into consideration that a difference in maximum hardness attendant on a difference in heating temperature is small, however, it is convenient from an aspect of improvement in productivity to increase the heating temperature and to shorten the retention time.

The aging effect proceeds in the course of preheating and hot extrusion of the green compact and hence, it is unnecessary to carry out a special aging treatment depending upon the preheating temperature, processing time and processing temperature for the green compact.

EXAMPLE 6

Aluminum alloy powders having compositions given in Table IX were produced under a condition of a cooling rate of $10^2$ to $10^{3°}$ C./sec. by utilizing a He gas atomizing process.

A solvent was mixed with the SiC whisker to effect an opening treatment. In this case, preferred solvents are of the type having a low viscosity, of a nature not reacting with the aforesaid alloy powders, and having a lower toiling point. The solvent used was a mixture of acetone and 13% of n butanol.

The opened SiC whiskers were mixed with the individual alloy powders to provide various green compacting materials. In this case, the fiber volume fraction (Vf) of the SiC whiskers was set at 20%.

The above materials were employed to produce a plurality of green compacts by utilizing a vacuum pressure molding process. The molding conditions were of a pressing force of 180 kg/mm$^2$ and a pressing retention time of one minute After molding, each green compact was subjected to a drying treatment in a vacuum at 80° C. for 10 hours.

Each green compact was placed into an extremely thin rubber bag and subjected to a CIP process to produce an intermediate. The producing conditions were of a pressing force of 4,000 kg/mm$^2$ and a pressing retention time of one minute.

The intermediate was subjected to a degassing treatment at 450° C. for one hour.

The resulting intermediate was subjected to a HIP process to produce a sinter. The producing conditions were of a pressing force of 2,000 atmospheric pressure, a heating temperature of 450° C. and a pressing retention time of one hour.

The sinter was employed to produce a bar like aluminum alloy sinter reinforced with the SiC whiskers by utilizing a hot extrusion process. The extruding conditions were of a heating temperature of 450 to 490° C. and an extrusion ratio of 10 or more.

The compositions and physical properties of sinters $G_1$ to $G_6$ which contain alloying elements within the limits of the present invention and are produced by the above procedure, are given in Table IX.

TABLE IX

| Sinter | Chemical constituents (% by weight) Cr | Fe | Zr | Al | SiC whisker Vf (%) | Tensile strength $\sigma_B$ (kg/mm$^2$) and elongation $\epsilon$ (%) A.T.*1 $\sigma_B$ | A.T.*1 $\epsilon$ | 300° C. $\sigma_B$ | 300° C. $\epsilon$ | Maximum diameter of precipitates and crystallizates (μm) |
|---|---|---|---|---|---|---|---|---|---|---|
| $G_1$ | 5 | 3 | 2 | Balance | 20 | 82 | 3.2 | 45 | 3.6 | ≦10 |
| $G_2$ | 8 | 3 | 2 | Balance | 20 | 91 | 2.1 | 52 | 3.5 | ≦10 |
| $G_3$ | 8 | 1 | 2 | Balance | 20 | 80 | 2.1 | 45 | 2.5 | ≦10 |
| $G_4$ | 8 | 3 | 0.5 | Balance | 20 | 79 | 2.9 | 44 | 3.6 | ≦10 |
| $G_5$ | 8 | 1 | 0.5 | Balance | 20 | 65 | 3.8 | 40 | 3.8 | ≦10 |

TABLE IX-continued

| Sinter | Chemical constituents (% by weight) Cr | Fe | Zr | Al | SiC whisker Vf (%) | Tensile strength $\sigma_B$ (kg/mm²) and elongation $\epsilon$ (%) A.T.*1 $\sigma_B$ | A.T.*1 $\epsilon$ | 300° C. $\sigma_B$ | 300° C. $\epsilon$ | Maximum diameter of precipitates and crystallizates (μm) |
|---|---|---|---|---|---|---|---|---|---|---|
| $G_6$ | 11 | 1 | 1 | Balance | 20 | 84 | 1.8 | 47 | 1.9 | ≦10 |

*1Ambient temperature

As apparent from Table IX, the sinters $G_1$ to $G_6$ of the present invention each have an excellent tensile strength and elongation at ambient temperature and at increased temperature (300° C.). In this case, it is desired that the maximum diameter of precipitates and crystallizates is of 10 μm or less.

Table X shows physical properties of the aluminum alloys used as a matrix, i.e.. the sinters $E_1$, $E_2$ and $e_1$ to $e_3$ given in the above Table IV. The tensile test was carried out at ambient temperature.

TABLE X

| Alloy (Sinter) | Tensile strength after aging (kg/mm²), at ambient temperature Treating condition 300° C., 10 hr | 400° C., 10 hr | 500° C., 10 hr | Hardness (Hmv) T.U.T. | T.T. |
|---|---|---|---|---|---|
| $E_1$ | 58 | 65 | 59 | 180 | 200 |
| $E_2$ | 60 | 69 | 61 | 183 | 217 |
| $e_1$ | 28 | 20 | 12 | 62 | 56 |
| $e_2$ | 38 | 25 | 15 | 111 | 85 |
| $e_3$ | 40 | 28 | 25 | 172 | 120 |

T.U.T. = Thermally untreated T.T. = Thermally treated

As apparent from Tables VI and X, the aluminum alloys $E_1$ and $E_2$ used in example of the present invention each have an excellent tensile strength at ambient temperature and increased temperatures have relatively large elongations and possesses good in hot processibility. Moreover, the tensile strength at ambient temperature can be substantially improved, particularly by setting the aging conditions at 400° C. and 10 hours. Furthermore, the hardness resulting from the thermal treatment also can be increased.

The alloy $E_2$ has properties shown in FIGS. 1 and 2 and hence, in producing the fiber-reinforced sinter $G_2$, it is recommended that the operation of a degassing treatment, a HIP treatment, a hot extrusion or the like is carried out at a temperature of 300 to 500° C., preferably 400 to 500° C. It is also possible, however, to perform a separate thermal treatment in the above temperature range.

Table XI shows a relationship between the maximum alloy powder diameter and the physical properties of the sinter $G_2$ formed using alloy $E_2$ and the SiC Whiskers so that the resulting fiber volume fraction (Vf) is 20%. The sinter $G_2$ is produced by the above described procedure. In this case, the extruding conditions are of a heating temperature of 450° C. and an extruding ratio of 20.

TABLE XI

| Maximum diameter (μm) | Relative density (%) | Tensile strength (kg/mm²), at ambient temperature | Elongation (%) | Estimation |
|---|---|---|---|---|
| 20 | 99 | 91 | 2.1 | Good |
| 40 | 99 | 90 | 2.0 | Good |
| 105 | 97 | 85 | ≦1 | Acceptable |
| >105 | 89 | 51 | ≦1 | Failure |
| 105* | 99 | 68 | 4.2 | — |

*A value of the maximum diameter of the alloy sample

As apparent from Table XI, if the maximum diameter of the alloy $E_2$ is 105μm or less, preferably 40;μm or less, it is possible to produce a sinter $G_2$ having excellent properties.

Table XII shows a relationship between the extrusion ratio and physical properties for a sinter produced using a powder of the alloy $E_2$ and having an average diameter of 20 μm.

TABLE XII

| E.R.*1 | P.T.*2 (°C.) | R.D.*3 (%) | T.S.*4 (kg/mm²) | Elo.*5 (%) | T.P.*6 | Estimation |
|---|---|---|---|---|---|---|
| 4 | 450 | 92 | — | — | Bad | Failure |
| 6 | 450 | 98 | 65 | ≦1 | Medial | Failure |
| 10 | 450 | 99 | 89 | 2.0 | Good | Good |
| 10 | 700 | 99 | 50 | 3.5 | Good | Failure |
| 14 | 450 | 99 | 89 | 2.0 | Good | Good |
| ≧20 | 450 | 99 | 91 | 2.1 | Good | Good |

*1Extrusion ratio
*2Processing temperature
*3Relative density
*4Tensile strength
*5Elongation
*6Thermal processibility As apparent from Table XII, it is desirable that the extrusion ratio is greater than or equal to 10, and the processing temperature is on the order of 450° C.

EXAMPLE 7

Aluminum alloy powders having a diameter of 105 μm or less and compositions given in Table XIII were produced under a condition of a cooling rate of $10^2$ to $10^{6}$° C./sec. by utilizing a He gas atomizing process.

The, the individual alloy powders were each mixed with SiC whiskers so that the fiber volume fraction given in Table XIII resulted, thus providing various green compacting materials.

The individual compacting materials were employed to produce a plurality of green compacts under a condition of a pressing force of 4,000 kg/cm² by utilizing a CIP process.

Then, the green compacts were placed into a soaking furnace at 450° C. and maintained for one hour to effect a degassing treatment. Degassing was followed by hot extrusion under conditions of a heating temperature of 450° C. and an extrusion ratio of 14, thus providing sinters $H_1$ to $H_3$, $h_1$ and $h_2$.

TABLE XIII

| Sinter | Chemical constituents (% by weight) Cr | Mn | Zr | Fe | Cu | Mg | Al | SiC W.* Vf (%) |
|---|---|---|---|---|---|---|---|---|
| $H_1$ | 8 | 2 | 2 | — | — | — | Balance | 15 |
| $H_2$ | 8 | 2 | — | 3 | — | — | Balance | 20 |
| $H_3$ | 8 | 2 | — | 6 | — | — | Balance | 20 |
| $h_1$ | 0.04 | 0.15 | — | — | 0.4 | 10 | Balance | 15 |
| $h_2$ | 0.04 | 0.15 | — | 0.7 | — | — | Balance | 20 |

*SiC whisker

Sinters $H_1$ to $H_3$ are examples prepared according to the present invention, while sinters $h_1$ and $h_2$ are comparative examples.

Test pieces were cut away from the individual sinters $H_1$ to $H_3$, $h_1$ and $h_2$, and subjected to a tensile test to provide the results given in Table XIV.

TABLE XIV

| Sinter | Tensile strength (kg/mm²) A.T.* | 200° C. | 300° C. | Elongation (%) A.T. | 200° C. | 300° C. |
|---|---|---|---|---|---|---|
| $H_1$ | 68 | 43 | 32 | 1.5 | 1.2 | 1.9 |
| $H_2$ | 70 | 50 | 38 | 1.0 | 1.5 | 2.0 |
| $H_3$ | 72 | 51 | 40 | 0.5 | 0.7 | 0.9 |
| $h_1$ | 70 | 38 | 18 | 2 | 1.5 | 0.8 |
| $h_2$ | 57 | 35 | 15 | 3 | 2.5 | 2.7 |

*Ambient temperature

As apparent from comparison of the sinters $H_1$ to $H_3$, prepared according to the present invention, with sinters $h_1$ and $h_2$ of the comparative examples. It can be seen that there is not a large difference in tensile strength at ambient temperature between the sinters reinforced with the SiC whisker, even if the compositions of matrices thereof are different. However, at an increased temperature of 300° C., the strength of the sinters $h_1$ and $h_2$ of the comparative examples is reduced considerably, whereas the sinters $H_1$ to $H_3$ according to the present invention are less reduced in strength. This is due to the difference in strength of the matrices at the increased temperature.

It can also be seen in the sinters $H_1$ to $H_3$ according to the present invention, that the elongation increases as the temperature increases, that the characteristic of elongation at the increased temperature depends upon the matrix, and the hot processibility of the matrix is good. In contrast, in the sinters $h_1$ and $h_2$ of the comparative examples. The elongation decreases as the temperature increases, and the matrix tends to become embrittled due to heating.

EXAMPLE 8

A quenched and solidified aluminum alloy powder of a diameter of 25 μm or less produced by a He gas atomizing process and having a composition of 8% by weight of Cr, 2% by weight of Zr, 3% by weight of Fe and the balance of Al was used. For the aluminum alloy powder, it is desirable that the maximum diameter of precipitates and crystallizates in the powder is approximately 10 μm or less in order to provide good tensile strength and elongation.

Placed into pot 4 of the vibration mill 1 shown in FIG. 3 were the above aluminum alloy powder and whiskers of silicon carbide having a fiber volume fraction (Vf) of 20%. The silicon carbide whiskers were not subjected to opening and screening treatments. The mixture was subjected to a mechanical dispersion process to provide a comPosite powder. The vibrating mill operating conditions were as follows: 4.0 kg stee) balls. 2.6 liters of solvent (hexane), a rate of rotation of 49 rpm, a frequency of 1,200/min., And a duration of operation equal to a approximately 100 hours.

Figure 5A:
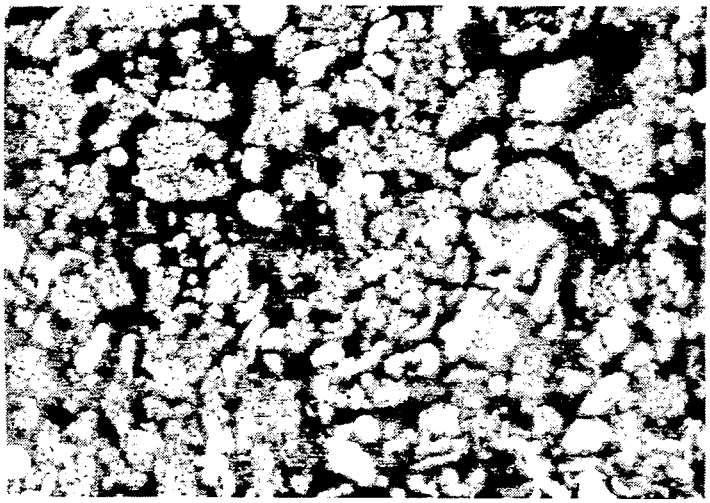
FIG. 5A is a microphotograph showing a structure of a composite powder.

FIG. 5A is a microphotograph (magnification 400 X) showing a structure of the composite powder. In the composite powder, it can be seen that the the black spot like whiskers of silicon carbide having a reduced aspect ratio are dispersed in the white aluminum alloy matrix.

The composite powder was subjected to a dry green compacting to provide a green compact having a diameter of 80 mm and a length of 70 mm. The molding conditions were of a primary molding pressure of 200 kg/cm² and a secondary molding pressure of 9.3 t/cm²

The green compact was heated to 500° C. and then placed into a container of an extruder where it was subjected to an extrusion process with an extrusion ratio of 13.2, while at the same time undergoing sintering thus providing a bar-like sinter having a diameter of 22 mm and a length of 900 mm.

Figure 5B:
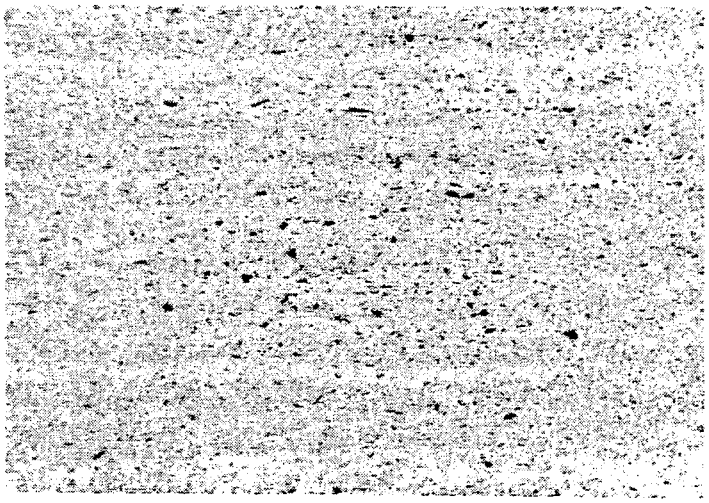
FIG. 5B is a microphotograph showing a structure of a sinter according to the present invention.

FIG. 5B is a microphotograph (magnification 400 X) showing a structure of the sinter. It can be seen from FIG. 5B that a variety of large and small black spot like whiskers of silicon carbide are uniformly dispersed in the gray aluminum alloy matrix. No aggregate of silicon carbide whiskers is present therein.

For comparison, observations were made by a microscope, of a mixed powder obtained in a mixer by mixing an aluminum alloy powder having the same composition as that described above with whiskers of silicon carbide which had been subjected to opening and screening treatments and had a fiber volume fraction of 20%. As a result it was found that the gray aluminum alloy powder and the black whisker of silicon carbide were not dispersed uniformly, and aggregates of silicon carbide whiskers were produced.

Figure 6:
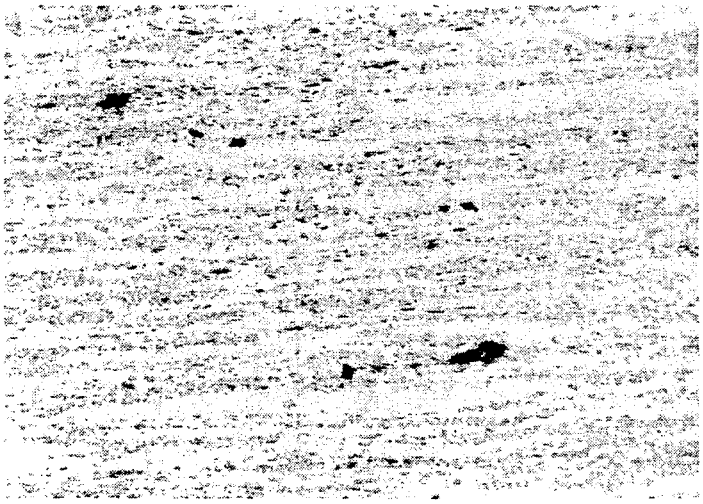
FIG. 6 is a microphotograph showing a structure of a sinter made in the prior art method.

FIG. 6 is a microphotograph (magnification 400 X) showing the structure of a bar-like sinter produced through green compacting and extrusion under the same conditions as in the above-described example shown in FIG. 5B, however, the above mixed powder was used to form due sinter. It can be seen from FIG. 6 that aggregates of silicon carbide whiskers are produced in the form of layers. The larger black spots are voids.

Test pieces were cut away from sinter J, produced according to the present invention, and sinter K, produced in the prior art method, and were tested for tensile strength and elongation at ambient temperature and 300° C. to provide results given in Table XV. In Table XV, sinter L corresponds to an example produced by using of particles of silicon carbide. The composition of its aluminum alloy matrix and the conditions or green compacting and extrusion are identical with those in the present invention. It was confirmed that aggregation of silicon carbide particles was produced even in this sinter L.

TABLE XV

| Sinter | Ambient temperature Tensile strength (kg/mm²) | Elongation (%) | 300° C. Tensile strength (kg/mm²) | Elongation (%) |
|---|---|---|---|---|
| J | 85 | 1.0 | 41 | 1.5 |
| K | 67 | 0 | 32 | 0 |
| L | 69 | 0.5 | 32 | 1.0 |

As apparent from the above Table XV, sinter J, produced according to the present invention, has a high tensile strength and elongation at ambient temperature and 300° C. as compared with those of the other sinters K and L and hence, has a high strength. This is attributable to the uniform dispersion of the silicon carbide whiskers in the aluminum alloy matrix.

It should be noted that the above-described green compacting step can be omitted when a sinter is produced employing a powder direct forgoing process or a powder direct extrusion process.

The sinters in the above described various examples are applicable to various structural members and are particularly suitable for structural components of internal combustion engines, e.g., connecting rods, valves, piston pins, etc.

We claim:

1. A heat-resistant aluminum alloy sinters comprising 5 to 12% by weight of Cr, less than 10% by weight of at least one element selected from the group consisting of Co, Ni, Mn, Zr, V, Ce, Fe, Ti, Mo, La, Nb, Y and Hf, and the balance of Al containing unavoidable impurities, wherein said sinter includes Fe and Zr, the Fe content being set in a range of 1 to 5% by weight, and the Zr content being set in a range of 0.5 to 3% by weight.

2. A heat-resistant aluminum alloy sinter according to claim 1, wherein said sinter contains precipitates and crystallizates with a maximum diameter of 10 μm or less.

3. A heat-resistant aluminum alloy sinter according to claim 1, wherein said sinter is produced through an aging treatment at a temperature of 350 to 500° C.

4. A fiber-reinforced heat-resistant aluminum alloy sinters comprising:

a matrix made of an aluminum alloy which comprises 5 to 12% by weight of Cr, less than 10% by weight of at least one element selected from the group consisting of Co, Ni, Mn, Zr, V, Ce, Fe, Ti, Mo, La, Nb, Y and Hf, and the balance of Al containing unavoidable impurities; and a reinforcing fiber which is a short fiber with a fiber volume fraction in a range of 2 to 30% wherein said sinter includes Fe and Zr, the Fe content being set in a range of 1 to 5% by weight, and the Zr content being set in a range of 0.5 to 3% by weight.

5. A fiber-reinforced heat-resistant aluminum alloy sinter according to claim 4, wherein the matrix contains precipitates and crystallizates with a maximum diameter of 10 μm or less.

6. A fiber-reinforced heat-resistant aluminum alloy sinter according to claim 4, wherein said sinter is produced through an aging treatment at a temperature of 350 to 500° C.

7. A fiber-reinforced heat-resistant aluminum alloy sinter accordant to claim 4, wherein the aluminum alloy matrix is made from a powder having a maximum diameter of 105 μm or less.

8. A fiber-reinforced heat-resistant aluminum alloy sinters according to claim 4, wherein the aluminum alloy matrix is a made from a powder having the maximum diameter of 40 μm or less.

9. A process for producing a fiber-reinforced heat-resistant aluminum alloy sinters consisting of an aluminum alloy matrix and whiskers of silicon carbide dispersed in the matrix, comprising the steps of:

mixing an aluminum alloy powder with whiskers of silicon carbide and at the same time pulverizing them by utilizing a mechanical dispersion process, thereby preparing a composite powder consisting of the aluminum alloy and the whiskers of silicon carbide, said aluminum alloy powder comprising 5 to 12% by weight of Cr, less than 10% by weight of at least one selected from the group consisting of Co, Ni, Mn, Zr, V, Ce, Fe, Ti, Mo, La, Nb, Y and Hf, and the balance of Al containing unavoidable impurities; and then subjecting said composite powder to a sintering treatment wherein said sinter includes Fe and Zr, the Fe content being set in a range of 1 to 5% by weight, and the Zr content being set in a range of 0.5 to 3% by weight.

10. A process for producing a fiber-reinforced heat-resistant aluminum alloy sinter as claimed in claim 4, said process comprising mixing an aluminum alloy powder, comprising 5 to 12% by weight of Cr, less than 10% by weight of at least one element selected from Co, Ni, Mn, Zr, V, Ce Fe, Ti, Mo, La, Nb, Y and Hf, and the balance of Al and impurities, with a reinforcing fiber which is a short fiber volume fraction in a range of 2 to 30%;

pulverizing the resultant mixture by a mechanical dispersion process, thereby forming a composite powder; and subjecting the composite powder to sintering.

11. A process for producing a heat-resistant aluminum alloy sinter as claimed in claim 1, said process comprising subjecting an aluminum alloy powder, comprising 5 to 12% by weight of Cr, less than 10% by weight of at least one element selected from Co, Ni, Mn, Zr, V, Ce, Fe, Ti, Mo, La, Nb, Y and Hf, and the balance of Al containing unavoidable impurities, wherein said sinter includes Fe and Zr, the Fe content being set in a range of 1 to 5% by weight, and the Zr content being set in a range of 0.5 to 3% by weight, to sintering.

* * * * *